US008733609B2

(12) United States Patent
Weigmann et al.

(10) Patent No.: US 8,733,609 B2
(45) Date of Patent: May 27, 2014

(54) DRIVE-IN DEVICE FOR FASTENING MEANS

(75) Inventors: Torsten Weigmann, Ronnenberg (DE); Olaf Hahndel, Pattensen (DE)

(73) Assignee: Illinois Tool Works Inc., Glenview, IL (US)

( * ) Notice: Subject to any disclaimer, the term of this patent is extended or adjusted under 35 U.S.C. 154(b) by 107 days.

(21) Appl. No.: 13/201,964

(22) PCT Filed: Feb. 17, 2010

(86) PCT No.: PCT/US2010/024351

§ 371 (c)(1), (2), (4) Date: Aug. 17, 2011

(87) PCT Pub. No.: WO2010/096401

PCT Pub. Date: Aug. 26, 2010

(65) Prior Publication Data

US 2011/0297726 A1 Dec. 8, 2011

(30) Foreign Application Priority Data

Feb. 18, 2009 (DE) ..... 20 2009 002 351 U

(51) Int. Cl.
*B27F 7/13* (2006.01)

(52) U.S. Cl.
USPC ..... 227/126; 227/131

(58) Field of Classification Search
USPC ..... 227/8, 126, 131, 128, 120, 130, 109, 227/135, 136
See application file for complete search history.

(56) References Cited

U.S. PATENT DOCUMENTS

| | | | | |
|---|---|---|---|---|
| 4,197,974 | A * | 4/1980 | Morton et al. | 227/8 |
| 5,433,367 | A | 7/1995 | Liu | |
| 5,588,577 | A * | 12/1996 | Chen | 227/120 |
| 5,653,371 | A * | 8/1997 | Hou | 227/109 |
| 6,056,181 | A * | 5/2000 | Chuang | 227/8 |
| 6,290,115 | B1 | 9/2001 | Chen | |
| 2004/0112933 | A1 | 6/2004 | Lamb | |
| 2006/0086589 | A1 | 4/2006 | Chen | |

FOREIGN PATENT DOCUMENTS

CN 2353498 Y 12/1999

OTHER PUBLICATIONS

International Search Report for PCT/US2010/024351 mailed May 20, 2010.
Chinese Office Action dated Jun. 27, 2013, issued in Chinese Patent Application No. 201080008171.9.

* cited by examiner

*Primary Examiner* — Thanh Truong
*Assistant Examiner* — Nathaniel Chukwurah
(74) *Attorney, Agent, or Firm* — Lowe Hauptman & Ham LLP

(57) ABSTRACT

In a fastening apparatus, a lockable slider is movably held along a magazine carrier, and coupled to a feeding element for a movement of fastening elements into an operating position below a firing pin. An adjustable retaining part for locking the slider is disposed on the magazine carrier, and has, in its locking position, at least one component section which protrudes into the feed path of the slider for a form closure with the slider in its locking position. The component section has at least one sliding surface running obliquely to the guide surfaces of the magazine carrier for shifting the retaining part from the locking position. The retaining part has a shoulder running approximately perpendicularly to the guide surfaces of the magazine carrier, which is configured so that it directly adjoins the obliquely running sliding surface.

18 Claims, 2 Drawing Sheets

DRIVE-IN DEVICE FOR FASTENING MEANS

RELATED APPLICATIONS

The present application is a National Phase of International Application Number PCT/US2010/024351, filed Feb. 17, 2010 and claims priority from, German Application Number 202009002351.6 filed Feb. 18, 2009.

The invention relates to a device for placing fastening means, in particular a drive-in device, comprising at least one magazine for the fastening means to be placed which are accommodated by means of a magazine carrier, wherein a lockable slider is movably held along the magazine carrier, said slider being coupled to a feeding element for a movement of the fastening elements into an operating position below a firing pin.

Known devices are, for example, gas-operated, electric or pneumatic drive-in devices or manually operable drive-in devices which are used, inter alia, for placing or shooting fastening means, such as staples, nails or the like, into a solid foundation. Thus, for example, materials can be fastened to framework structures, in particular in the manufacture of upholstered furniture, or large-area films or tarpaulin material can be fastened to walls or ceiling structures of a building. To this end, such drive-in devices normally have a firing pin which is to be actuated via a trigger and by means of which the fastening means possibly accommodated in a magazine are driven one after the other into material layers to be connected to one another in each case. The magazine has a magazine carrier for the fastening means, which as a rule are lined up thereon one behind the other and are designed, for example, as staple strips. Furthermore, a slider is movably held along the magazine carrier, said slider continuously exerting, via a feeding element coupled thereto, a force on the fastening means accommodated on the magazine carrier. Therefore, during the successive placing, the fastening means are always pushed up in the direction of the firing pin, such that at least one fastening means is always disposed underneath the firing pin. To load the magazine of a drive-in device, the slider is moved to the rear end of the magazine carrier and locked there. For this purpose, the magazine carrier can have an undercut on its top edge, which serves as seating or guide surface for both the fastening means and the slider, in which undercut the slider then engages by being rotated. On account of the locked slider, the magazine can now be loaded with, for example, a staple stack or strip. In order to neutralize the locking of the slider at the end of the magazine carrier again, said slider is to be moved out of the undercut of the magazine carrier. In the process, the neutralizing by means of a hand possibly protected by a protective glove can turn out to be relatively problematic, as a result of which the drive-in device is sometimes not made ready for use again until after a delay of up to 5 seconds.

The object of the present invention here is to improve a device of the type designated above to the effect that the operation of loading the magazine can be carried out in a simplified manner and thus in a shorter time.

The object is achieved according to the invention by a device having the features of patent claim 1. Advantageous developments and configurations of the invention are specified in claims 2 to 8.

In a device for placing fastening means, in particular a drive-in device, comprising at least one magazine for the fastening means to be placed which are accommodated by means of a magazine carrier, wherein a lockable slider is movably held along the magazine carrier, said slider being coupled to a feeding element for a movement of the fastening elements into an operating position below a firing pin, provision is made according to the invention for an adjustable retaining part for locking the slider to be disposed on the magazine carrier, which retaining part has, in its locking position, at least one component section which protrudes into the feed path of the slider for a form closure with the slider, wherein the component section has at least one sliding surface running obliquely to the guide surfaces of the magazine carrier for shifting the retaining part from the locking position.

By means of such a retaining part, designed according to the invention, on the magazine carrier, advantageously simple locking of the slider, in particular on the rear end of the magazine carrier, can be carried out on the one hand and the locking of the slide can be neutralized again in a likewise advantageous manner on the other hand using the fastening means, present as a staple strip for example, immediately after the magazine has been filled. To this end, in particular the staple strip put or inserted into the magazine is to be displaced in the direction of the rear end of the magazine carrier, such that said staple strip is likewise moved right up to the slider via the sliding surface of the retaining part, said sliding surface protruding into the feed path of the slider. At the same time, the retaining part, which if need be is displaceable transversely to the longitudinal axis of the magazine carrier, is thereby moved out of its locking position and the slider is moved back by the feeding element thereof, which is designed, for example, as a scroll spring, in the direction of the firing pin. Complicated unlocking of the slider by renewed actuation of the same or by the actuation of a separate trigger is therefore not necessary, for which reason the operation of loading the device according to the invention can be carried out in a simplified manner and advantageously in a shorter time.

According to an advantageous development of the invention, the retaining part has a shoulder which runs approximately perpendicularly to the guide surfaces of the magazine carrier and which is configured so that it directly adjoins the obliquely running sliding surface. Such a design of the component section protruding outward provides for a simple structural configuration of the retaining part, as a result of which the form closure between the slider and the shoulder adjoining the sliding surface can always be reliably ensured when the slider is pulled back. In addition, the form closure can likewise be released again without any problems after the filling of the fastening means and the subsequent displacement of the fastening means in the direction of the locked slider. In this case, the sliding surface preferably runs at a small angle, in particular of about 5 to 35 degrees, to the guide surfaces of the magazine carrier, so that, when the fastening means slide across, the retaining part cannot be jammed or become caught on the fastening means. In the process, however, an advantageous disengaging function at least of the component section protruding at the outer contour of the magazine carrier can also be ensured.

The retaining part is a retaining clasp extending in the longitudinal direction of the magazine carrier, one end of which is connected firmly to the magazine carrier. The design of the retaining part as a clasp body constitutes a structurally advantageous configuration, as a result of which the retaining part does not need to be slidingly accommodated transversely to the longitudinal axis of the magazine carrier. One end of the retaining clasp is fixedly disposed on the magazine carrier, in which case the opposite end can be pivoted inside the magazine carrier, which is formed, for example, from a hollow profile. As a result, in particular yielding of the component section, protruding at the outer contour, of the retaining part is possible when the slider is slid completely across or due to the fastening means, which are pushed at least partly over said component section. The retaining part according to the invention has the advantageous property, in particular after the yielding, of assuming its original orientation again, such that the component section serving to lock the slider normally protrudes at the outer contour of the magazine carrier. Alternatively, it is possible to design the retaining part as a flexurally stiff component which is slidingly accommodated in a guide oriented perpendicularly to the guide surfaces of the magazine carrier. In this case, a force can be produced in the direction of the locking position of the retaining part by means of a spring element designed in particular as a coiled spring.

The retaining part designed as a retaining clasp can preferably be formed from a material having resilient properties, plastics or metallic materials, for example, being used. In this connection, the retaining part can have a relatively small material thickness, thereby ensuring advantageous resilience of the retaining part. At the same time, a material which ensures an advantageously operationally reliable long-time function of the device is used for the retaining part. This is because, during the handling of the device according to the invention, the magazine is to be refilled at relatively short intervals on account of its correspondingly limited accommodating capacity, a factor which leads to actuation of the slider and therefore deformation of the retaining part.

According to a development of the invention, the retaining part has at least one trigger to be actuated separately. By means of a trigger which is additionally provided on the device and is actuated in particular from the rear front-face end region of the magazine carrier, the locking of the slider can likewise be neutralized in a simple manner after the filling of the magazine with fastening means. For persons who initially have difficulties with the novel triggering mechanism according to the invention for the slider, it is therefore still possible to unlock the slider in a conventional manner by means of a separate trigger. The latter, however, in contrast to the known triggers, can be manipulated in an advantageously simplified manner.

The trigger is in particular accommodated slidingly parallel to the longitudinal axis of the magazine carrier, wherein the trigger and the retaining part have run-on surfaces running obliquely to the longitudinal axis of the magazine carrier in abutment with one another. Advantageous actuation of the retaining part is provided for by the trigger being accommodated slidingly parallel to the longitudinal axis of the magazine carrier. In this case, the trigger, which is arranged behind the retaining part in the longitudinal direction of the magazine carrier and which can be formed from a clasp part of one-piece design and an actuating head assigned to the clasp part, comprises in particular an adjusting part corresponding to the retaining part and an actuating member projecting at the rear front end of the magazine carrier. When the trigger is actuated, said trigger is displaced parallel to the longitudinal axis of the magazine carrier, with the result that the run-on surfaces in abutment with one another slide on one another, such that the freely movable end of the retaining part is pivoted in such a way that the component section, protruding at the outer contour, of the retaining part is moved again out of the travel path of the slider and the slider is brought directly into abutment with the fastening means that have just been accommodated in the magazine. Here, too, the trigger can consist of a flexurally stiff component.

In addition, provision is made for the trigger to be equipped with at least one restoring device which always moves the trigger back into its original disengaging position after actuation has been effected and therefore can at the same time also move the retaining part back into its actual locking position. If necessary, unintentional automatic triggering of the unlocking of the retaining part can also be avoided by means of the restoring device, a factor which further improves the functional reliability of the device according to the invention.

Another development of the invention provides for the restoring device to be a compression spring acting against the direction of actuation of the trigger. The use of a compression spring as a restoring device constitutes an advantageously simple possibility of designing a restoring device. The spring force of the compression spring preferably acts against the direction of actuation of the trigger, wherein the compression spring is supported with one end on the actuating member of the trigger and is disposed with its other end if need be in a fixed position on a section or region of the magazine carrier.

An exemplary embodiment of the device according to the invention, from which further inventive features are obtained, is shown in the drawing, in which.

Figure 1:
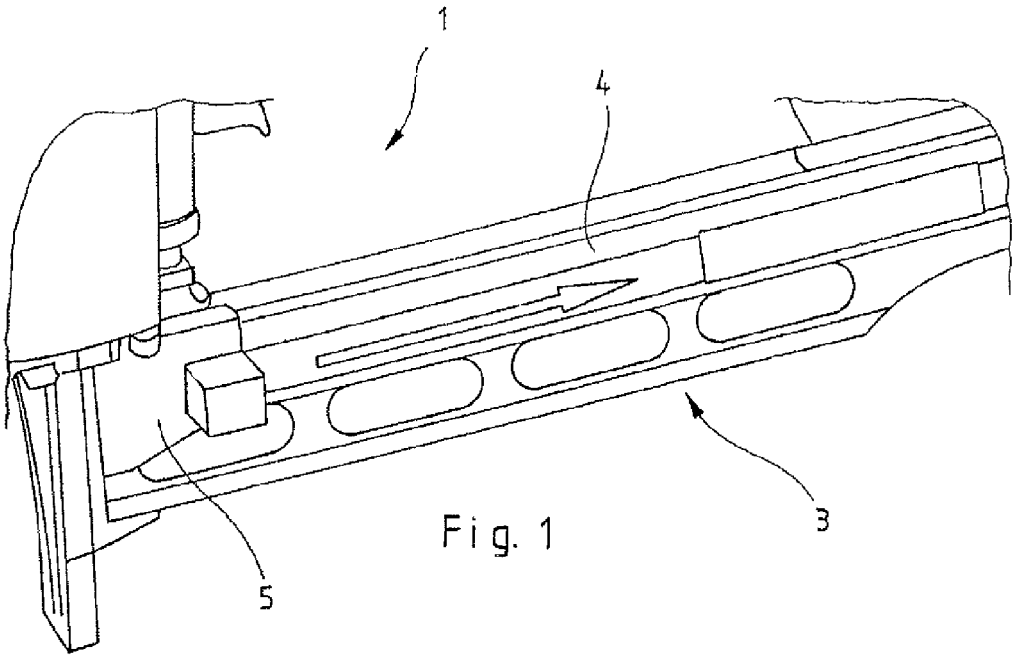
FIG. 1 shows a partial view of a device according to the invention.

FIG. 1 shows a drive-in device 1 for in particular staple-like fastening means (FIG. 3) which are accommodated in a magazine 3. The magazine 3 has at least one magazine carrier 4, on which the fastening means are normally lined up one behind the other, and a slider 5 held slidingly along the magazine carrier 4. In this case, the fastening means 2 located on the magazine carrier are continuously moved by means of the slider 5 into an operating position below a firing pin (not shown in any more detail). To this end, the slider 5 is coupled to a spring element (not shown in any more detail) which is designed in particular as a scroll spring and which ensures the feed of the slider 5 in the direction of the firing pin.

Figure 2:
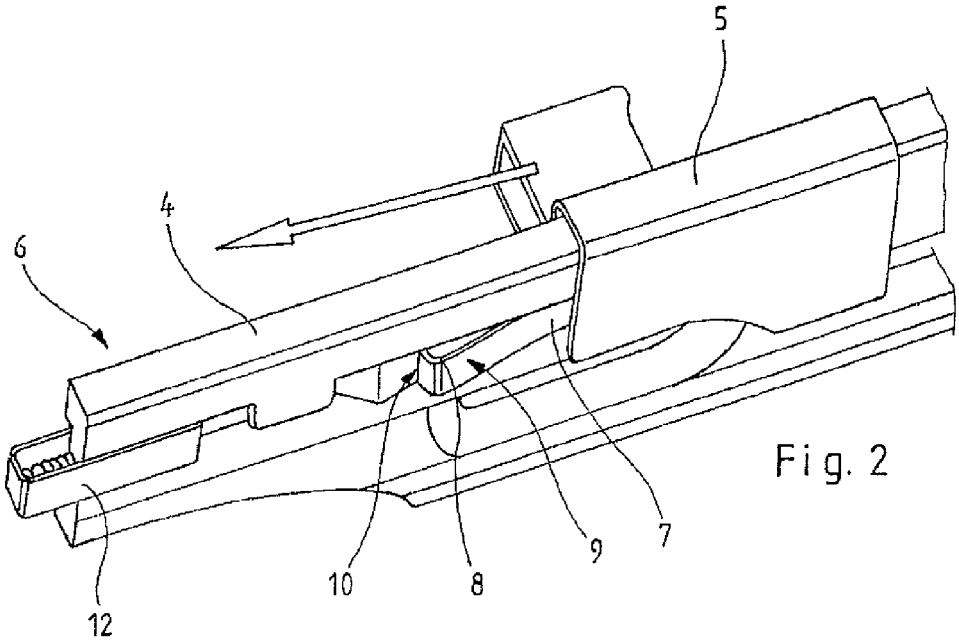
FIG. 2 shows a detailed view of a magazine according to FIG. 1 designed according to the invention.

In order to be able to load an empty magazine 3 again with fastening means 2, the slider 5, as shown in FIG. 2, is displaced to the rear end 6 of the magazine carrier 4. The slider is automatically locked on the magazine carrier end 6 in particular by running over a retaining part 7 disposed on the magazine carrier. To this end, the retaining part 7 has a component section 8 which protrudes at the outer contour of the magazine carrier and which in particular produces a form closure with the slider 5. In order to be able to ensure that the slider runs over the retaining part 7 to the magazine carrier end, the component part 8 has a sliding surface 9 running obliquely to the guide surfaces of the magazine carrier 4. Directly adjoining said sliding surface 9, a shoulder 10 running approximately perpendicularly to the guide surfaces of the magazine carrier is formed on the component section 8, said shoulder 10 serving as a support for the slider 5 to be locked.

Figure 3:
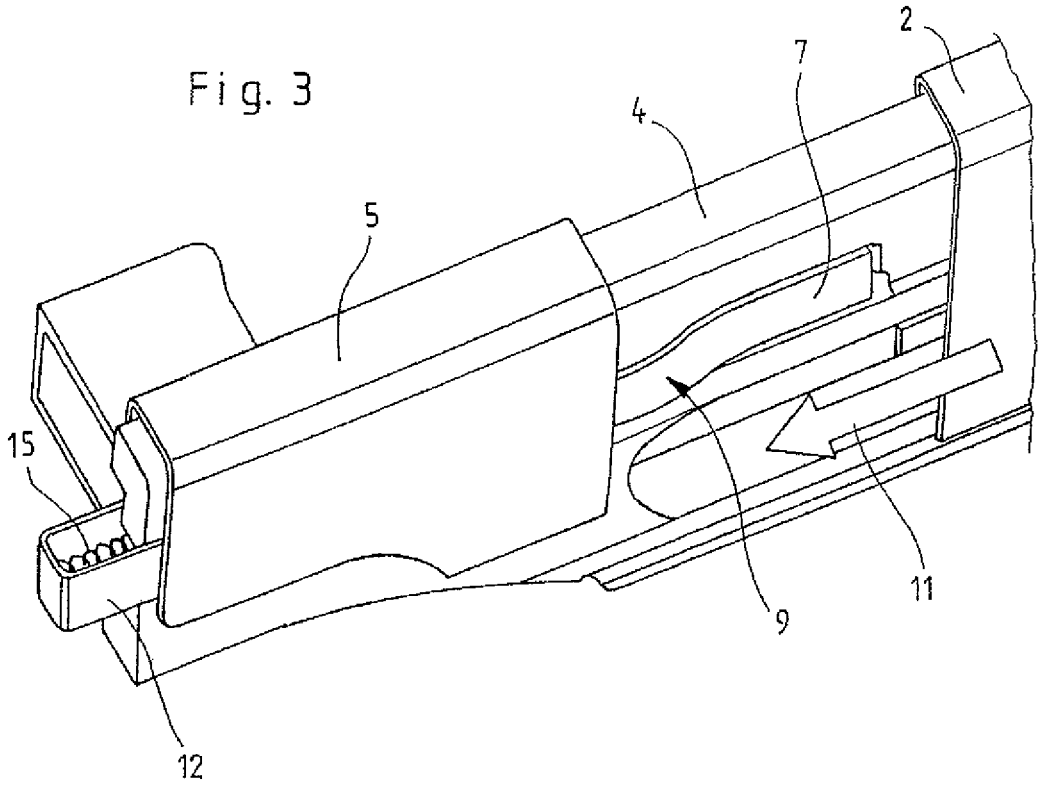
FIG. 3 shows a perspective view of the magazine with locked slider.
Figure 4:
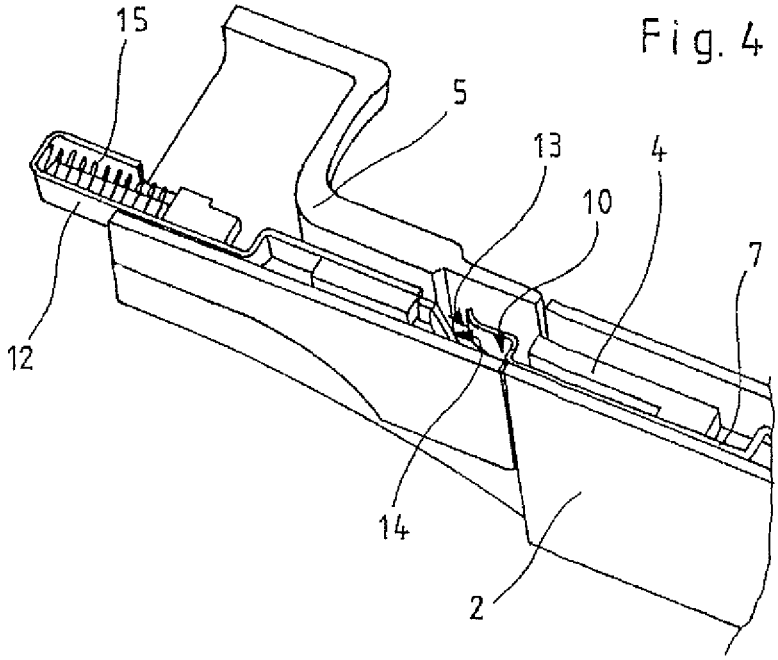
FIG. 4 shows a perspective view of the magazine in section, this view showing how the locking of the slider is neutralized.

The slider 5 locked on the end 6 of the magazine carrier 4 is shown in FIG. 3, wherein, to neutralize the locking, the fastening means, which have just been put onto the magazine carrier, are likewise moved in the direction of arrow 11. As soon as the fastening means come into contact with the sliding surface 9 of the component section 8 of the retaining part 7, the retaining part 7 preferably being made of a resilient material, the component section 8, which otherwise protrudes at the outer contour of the magazine carrier 4, yields inwardly. If the fastening means are pushed right up to the slider 5, as illustrated in FIG. 4, the locking of the slider 5 is neutralized, with the result that the slider 5 is moved by the spring element thereof in the direction of the front magazine carrier end. In addition, the retaining part 7 has a trigger 12 which is disposed on the rear magazine carrier end 6 and which is held slidingly in the longitudinal direction of the magazine carrier 4. The retaining part 7 and the trigger 12 have run-on surfaces 13, 14 which are in abutment with one another and which are each oriented obliquely to the longitudinal axis of the magazine carrier 4 and slide on one another when the trigger 12 is actuated, as a result of which the free end of the preferably deformable retaining part 7 is likewise pivoted inward and the slider 5 can travel right up to the front magazine carrier end. Furthermore, the trigger 12 is equipped with a restoring device 15 which acts against the direction of actuation of the trigger and is designed as a compression spring.

The invention claimed is:

1. A device for placing fastening means, comprising at least one magazine for the fastening means to be placed which are accommodated by means of a magazine carrier, wherein a lockable slider is movably held along the magazine carrier, said slider being coupled to a feeding element for a movement of the fastening elements into an operating position below a firing pin, wherein an adjustable retaining part for locking the slider is disposed on the magazine carrier, which retaining part has in its locking position, at least one component section which protrudes into the feed path of the slider for a form closure with the slider, wherein the component section has at least one sliding surface running obliquely to the guide surfaces of the magazine carrier for shifting the retaining part from the locking position, and wherein at least one of:

(i) the retaining part is a retaining clasp extending in the longitudinal direction of the magazine carrier, one end of which is connected firmly to the magazine carrier;

(ii) the retaining part has at least one trigger to be actuated separately; or (iii) the adjustable retaining part is fixed to the magazine carrier.

2. The device, comprising:

an apparatus configured to place fasteners, including:

a means for placing the fasteners;

a magazine carrier configured to support the fasteners prior to placement of the fasteners;

a means for sliding movably held along the magazine carrier, wherein the means for sliding is coupled to a feeding element for a movement of the fasteners into the operation position via the means for sliding to a location below a firing pin of the device;

a means for locking the slider relative to the magazine carrier; and a means for releasing the means for locking, the means for releasing the means for locking being movable relative to the means for sliding.

3. A device for placing fastening means, comprising at least one magazine for the fastening means to be placed which are accommodated by means of a magazine carrier, wherein a lockable slider is movably held along the magazine carrier, said slider being coupled to a feeding element for a movement of the fastening elements into an operating position below a firing pin, wherein an adjustable retaining part, having at least a portion movable relative to the slider, for locking the slider is disposed on the magazine carrier, which retaining part has, in its locking position, at least one component section which protrudes into the feed path of the slider for a form closure with the slider, wherein the component section has at least one sliding surface running obliquely to the guide surfaces of the magazine carrier for shifting the retaining part from the locking position, and wherein at least a portion of the at least one sliding surface is movable relative to another portion of the adjustable retaining part, thereby at least one of locking or unlocking the slider.

4. The device according to claim 1, characterized in that the retaining part has a shoulder running approximately perpendicularly to the guide surfaces of the magazine carrier, which is configured so that the retaining part directly adjoins the obliquely running sliding surface.

5. The device according to claim 3, characterized in that the material for the retaining part is a material having resilient properties.

6. The device according to claim 3, characterized in that the retaining part has at least one trigger to be actuated separately.

7. The device according to claim 6, characterized in that the trigger is accommodated slidingly parallel to the longitudinal axis of the magazine carrier, wherein the trigger and the retaining part have run-on surfaces running obliquely to the longitudinal axis of the magazine carrier in abutment with one another.

8. The device according to claim 6, characterized in that the trigger is equipped with at least one restoring device.

9. The device according to claim 8, characterized in that the restoring device is a compression spring acting against the direction of actuation of the trigger.

10. The device according to claim 3, wherein the device for placing means is a drive-in device.

11. The device according to claim 3, wherein the adjustable retaining part is fixed to the magazine carrier.

12. The device according to claim 3, wherein the device is configured such that the slider is movable relative to the adjustable retaining part and wherein the slider is a separate component from the adjustable retaining part.

13. A device, comprising:

an apparatus configured to place fasteners, including:

a magazine carrier configured to support the fasteners prior to placement of the fasteners;

a slider system configured to apply a compressive force onto the fasteners via a slider supported by the magazine carrier such that the fasteners are urged to a shooting location of the device, wherein at least a first component of the slider is configured to move relative to the magazine carrier and directly apply the compressive force onto the fasteners, wherein the device is configured to both releasably lock the slider system relative to the magazine carrier and release the lock with a longitudinal and all lateral orientations of the first component of the slider relative to a longitudinal and all lateral orientations of the magazine carrier remaining constant.

14. The device of claim 13, further comprising:

an adjustable retaining part fixed to the magazine carrier, the adjustable retaining part configured to releasably lock the slider of the slider system relative to the magazine carrier.

15. The device of claim 14, wherein the slider is configured to abut the fasteners, and wherein the device is configured such that the slider moves relative to the adjustable retaining part.

16. The device of claim 14, wherein the adjustable retaining part is made of a flexible material.

17. The device of claim 13, further comprising a trigger system configured to unlock the slider.

18. The device of claim 13, further comprising a trigger system configured to unlock the slider without moving the slider.

* * * * *